US005106216A

United States Patent [19]

Kim

[11] Patent Number: 5,106,216

[45] Date of Patent: Apr. 21, 1992

[54] DEVICE FOR DRIVING A PLATEN AND CARRIAGE OF A PRINTING MACHINE

[75] Inventor: Ahn-Guk Kim, Kyounggi, Rep. of Korea

[73] Assignee: SamSung Electronics Co., Ltd., Suwon, Rep. of Korea

[21] Appl. No.: 606,485

[22] Filed: Oct. 31, 1990

[30] Foreign Application Priority Data

Nov. 22, 1989 [KR] Rep. of Korea ..... 17282/1989

[51] Int. Cl.[5] ..... B41J 23/34

[52] U.S. Cl. ..... 400/185; 400/320; 400/187

[58] Field of Search ..... 400/185, 187, 320, 322, 400/328, 568

[56] References Cited

U.S. PATENT DOCUMENTS

| | | | |
|---|---|---|---|
| 4,030,588 | 6/1977 | Hanagata et al. | 400/320 |
| 4,420,763 | 12/1983 | Cuel et al. | 400/185 |
| 4,538,931 | 9/1985 | Nagashima | 400/185 |
| 4,752,786 | 6/1988 | Inoue et al. | 400/185 |
| 4,822,186 | 4/1989 | Hanpoka et al. | 400/320 |
| 4,920,258 | 4/1990 | Saito | 400/185 |

FOREIGN PATENT DOCUMENTS

| | | | |
|---|---|---|---|
| 0003912 | 1/1980 | Japan | 400/185 |
| 0142683 | 11/1980 | Japan | 400/185 |
| 0018279 | 1/1987 | Japan | 400/187 |
| 0046669 | 2/1987 | Japan | 400/185 |

*Primary Examiner*—Edgar S. Burr
*Assistant Examiner*—Christopher A. Bennett
*Attorney, Agent, or Firm*—Robert E. Bushnell

[57] ABSTRACT

There is disclosed a device for driving a platen and carriage of a printing machine comprises a motor with a motor gear, a platen drive gear and a carriage drive gear, characterized in that the motor gear may be only selectively engaged with one of the platen drive gear or carriage drive gear according to whether the platen or carriage should be moved. Thus, the number of the components relating to the device for driving the platen and carriage is considerably reduced, thus simplifying the construction so as to achieve an economical advantage.

2 Claims, 2 Drawing Sheets

DEVICE FOR DRIVING A PLATEN AND CARRIAGE OF A PRINTING MACHINE

BACKGROUND OF THE INVENTION

The present invention relates to a device for driving a platen and carriage of a printing machine such as typewriter, printer, etc.

Conventionally, the printing machine employs separate devices for respectively driving the platen to transfer a paper and the carriage to move the printing head. Hence, such a conventional printing machine should afford an undesirable large space required for installing the separate driving devices, which are a kind of step motors. Moreover, each of the devices requires a separate system for transmitting the torque of the motor to a following gear. These serve one of the factors increasing the cost of production.

SUMMARY OF THE INVENTION

It is an object of the present invention to provide a device that enables one and the same motor to be used for driving the platen and carriage.

According to the present invention, a device for driving a platen and carriage of a printing machine comprises a motor with a motor gear, a platen drive gear and a carriage drive gear, characterized in that the motor gear may be only selectively engaged with one of the platen drive gear or carriage drive gear according to whether the platen or carriage should be moved. Thus, the number of the components relating to the device for driving the platen and carriage is considerably reduced, thus simplifying the construction so as to achieve an economical advantage.

The present invention will now be described more specifically with reference to the drawings attached only by way of example.

BRIEF DESCRIPTION OF THE ATTACHED DRAWINGS

DETAILED DESCRIPTION OF THE PREFERRED EMBODIMENT

Figure 1:
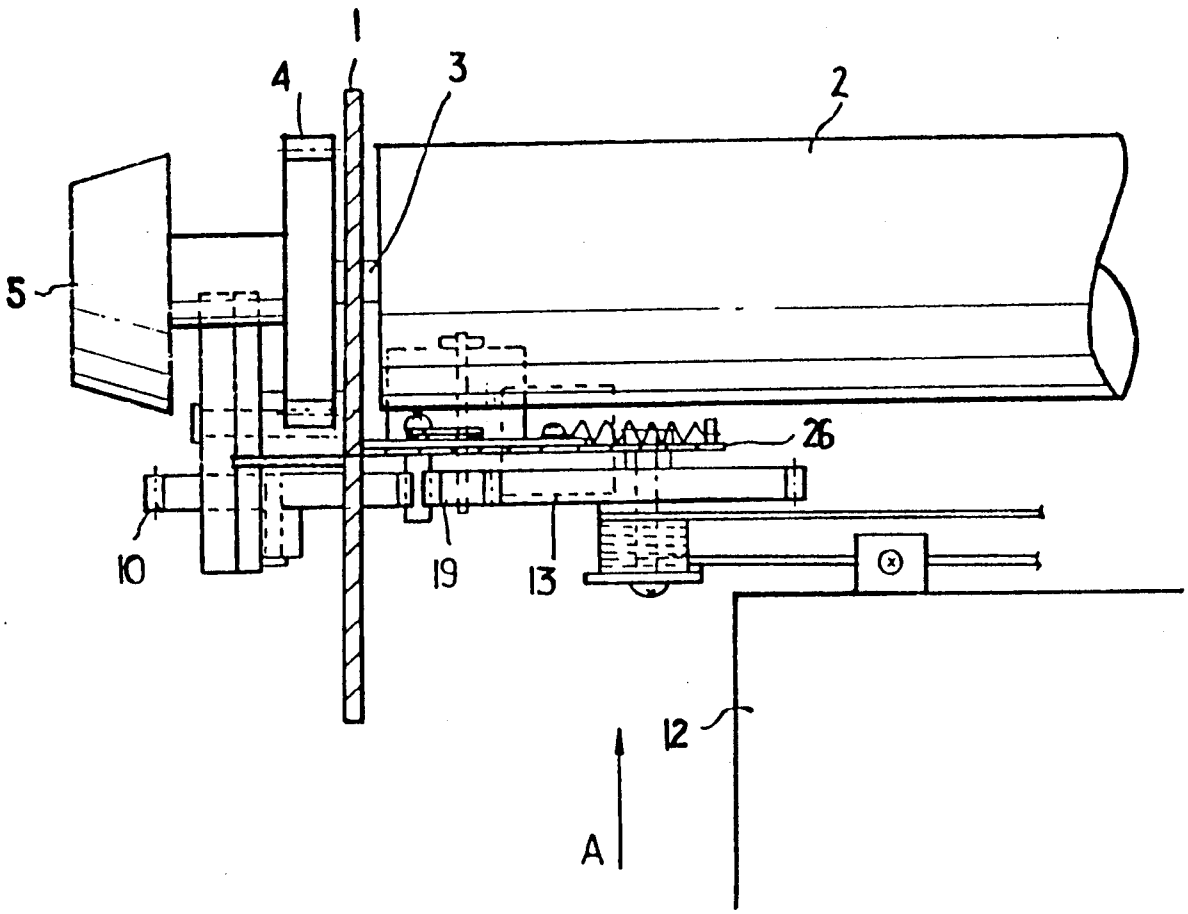
FIG. 1 is a plane view for partially illustrating the inventive device.
Figure 2:
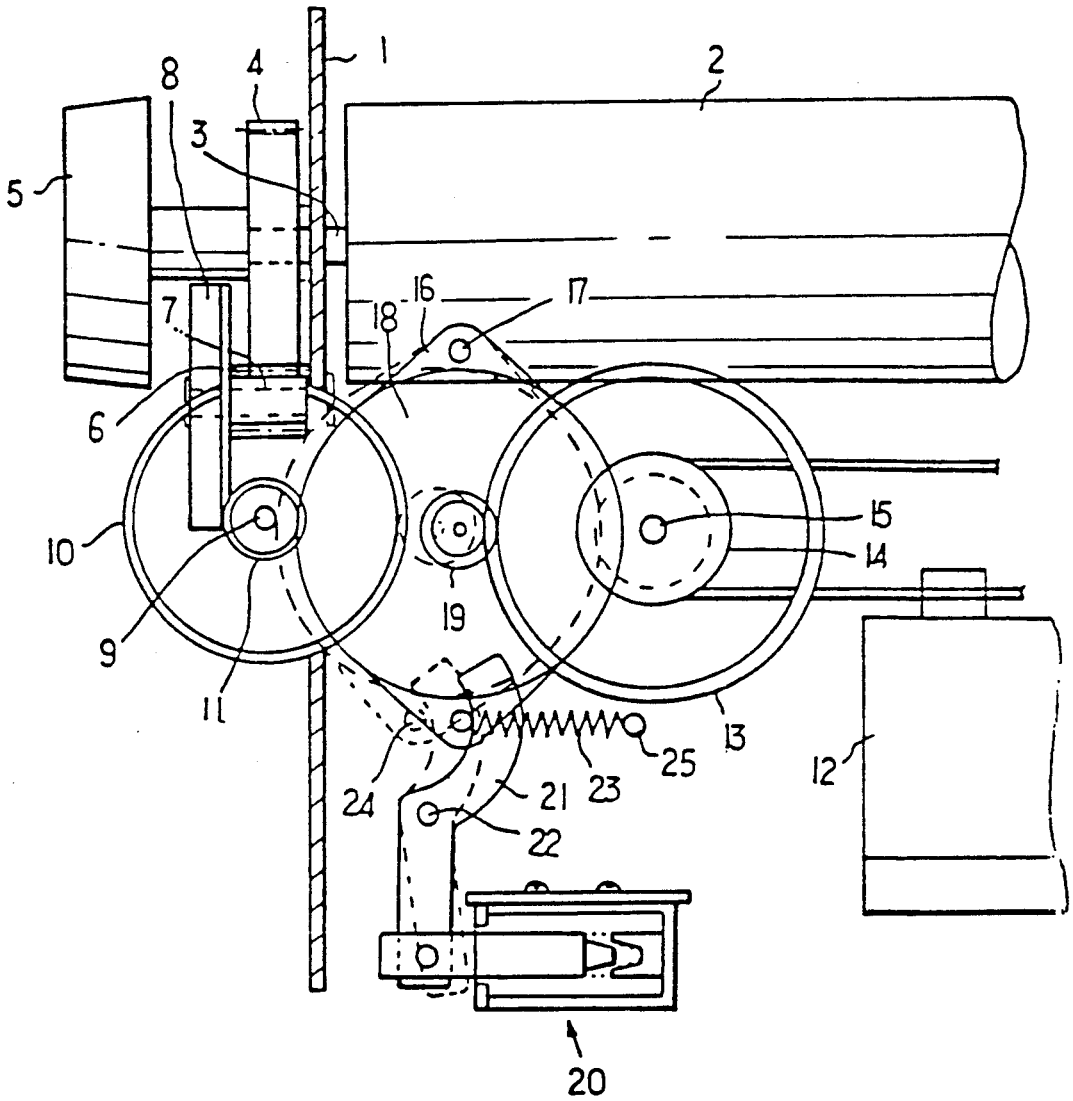
FIG. 2 is an enlarged side view taken in the direction of A of FIG. 1 for illustrating the operation of the inventive device.

Reference is made to FIGS. 1 and 2 to specifically illustrate an embodiment of the present invention.

The rotating shaft 3 of a platen 2 is rotatably mounted on a side frame 1. The end of the rotating shaft 3 penetrating outside the side frame 1 has a platen gear 4 and a manually operated knob 5 fixed thereto.

The platen gear 4 is engaged with a small transmission gear 6 that is rotatably mounted on a shaft 7 fixed in parallel with the platen 2 in the side frame 1. On the outer end of the gear 6 is a large transmission bevel gear 8 fixed.

Between the platen 2 and carriage 12 is subordinate frame 26 set in parallel with the platen. A pair of shafts 9 and 15 are fixed in the subordinate frame 26 perpendicularly to the length of the platen towards the carriage 12. On the outer shaft 9 is rotatably mounted a drive gear 10 having a small bevel gear 11 concentrically attached thereto, which bevel gear 11 is engaged with the bevel gear 8. On the inner shaft 15 is rotatably mounted a drive gear 13 having a wire pulley 14 concentrically attached thereto. Hereinafter, the former and the later drive gears 10 and 13 are respectively referred to as the platen drive gear and the carriage drive gear. The distance between the two shafts of both drive gears 10 and 13 is fixed.

A motor 18 is arranged between the two drive gears 10 and 13 so that a motor gear 19 fixed on the shaft of the motor may be only selectively engaged with one of the two gears. Namely, a motor bracket 16 is pivotably attached to the subordinate frame 26 by means of a pivot 17 mounted on the upper end thereof, and a motor 18 with a motor gear 19 is mounted on the bracket 16.

There is arranged a tension spring 23 having one end attached to a pin 24 fixed on the lower end of the motor bracket 16 and the other end attached to another pin 25 fixed on the subordinate frame 26, so that the motor gear !9 of the motor 18 is normally engaged with the carriage drive gear 13 of the pulley 15. On the other hand, a push lever 21 is installed for pushing the pin 24 towards the platen drive gear 10, so that the motor gear 19 may be engaged with the platen drive gear 10 against the force of the tension spring 23. A solenoid 20 is to drive the push lever 21. The center of the push lever 21 is pivotably mounted on a pin fixed 22 to the subordinate frame 26. The upper portion of the push lever is made arcuate adapted for the pin 24, and the lower end thereof is connected to the solenoid 20.

Thus, the connection between the motor gear 19 and the carriage drive gear 13 is achieved by means of the tension spring 23, while the connection between the platen gear 10 and the motor gear 19 is achieved by means of the link mechanism of the solenoid 20—push lever 21.

In operation of the inventive device, the torque of the motor is only connected to the platen 2 when a printed paper is transferred for a next line printing, while it is only transmitted to the carriage 12 during a cycle of the carriage reciprocation along the platen 2 for one line printing. The completion of a cycle of the carriage reciprocation for one line printing automatically generates a signal to initiate the solenoid 20, according to which signal the printed paper is transferred for the next line printing. The completion of transferring the printing paper automatically generates a signal to cut the current to the solenoid 20. Then, the carriage begins the printing operation.

As described above, the inventive device employs a single motor 18 arranged between the platen drive gear 10 and the carriage drive gear 13 so that the motor 18 may be selectively pivoted on the pin 17 to engage one of the two drives 10 and 13 with the help of the tension spring 23 and the link mechanism of the solenoid 20—push lever 21, thereby considerably decreasing the number of the components relating to the motor as well as the transmission system. Hence, a considerable economical advantage is achieved together with the simplified construction, whereby the motor gear 19 may be only selectively engaged with one of the platen drive gear 10 and carriage drive gear 13.

What is claimed is:

1. A device for driving a platen and carriage of a printing machine comprising a side frame 1, the platen 2 having a rotating shaft 3, a platen gear 4 fixedly mounted on said rotating shaft 3, a manually operated knob 5 fixed on the end of said shaft 3 having said platen gear 4, a wire pulley 14 for reciprocating a carriage 12, a subordinate frame 26 arranged perpendicularly to said side frame 1 between said platen 2 and said carriage 12, a pair of shafts 9 and 15 fixed in said subordinate frame 26 in parallel with each other, a platen drive gear 10 rotatably mounted on the outer shaft 9, a small bevel gear 11 concentrically attached on said platen drive gear 10, a carriage drive gear 13 rotatably mounted on the inner shaft 15, said wire pulley 14 concentrically attached on said carriage drive gear 13, a motor bracket 16 pivotably attached to said subordinate frame 26 by means of a pivot 17 mounted on the upper end thereof, a motor 18 with a motor gear 19 mounted on said bracket 16, a tension spring 23 having one end attached to a pin 24 fixed on the lower end of said motor bracket 16 and the other end attached to another pin 25 fixed on said subordinate frame 26, a push lever 21 for pushing the pin 24 towards said platen drive gear 10, and a solenoid 20 for driving said push lever 21, whereby said motor gear 19 may be only selectively engaged with one of said platen drive gear 10 and carriage drive gear 13.

2. A device for driving a platen and carriage of a printing machine, comprising:

a side frame;

a platen having a rotating shaft;

a platen gear fixedly mounted on said rotating shaft;

a manually operate knob fixed on the end of said shaft having said platen gear;

a wire pulley for reciprocating a carriage;

a subordinate frame arranged perpendicularly to said side frame between said platen and said carriage;

a plurality of shafts and fixed in said subordinate frame in parallel with each other;

a platen driving gear rotatably mounted on an outer one of said shafts;

a small gear concentrically attached on said platen drive gear;

a carriage drive gear rotatably mounted on an inner one of said shafts;

said wire pulley concentrically attached on said carriage drive gear;

a motor bracket pivotably attached to said subordinate frame by means of a pivot mounted on the upper end thereof;

a motor with a motor gear mounted on said bracket;

a tension spring having a first end attached to said motor bracket and a second end attached to said subordinate frame;

a push lever for urging the first end towards said platen drive gear; and whereby said motor gear may be selectively engaged by one of said platen drive gear and carriage drive gear.

* * * * *